US010279392B2

(12) United States Patent
Nishida et al.

(10) Patent No.: US 10,279,392 B2
(45) Date of Patent: May 7, 2019

(54) LADLE TRANSPORT CAR AND MOLTEN METAL TRANSPORT LINE

(71) Applicants: SINTOKOGIO, LTD., Nagoya-shi, Aichi (JP); Fujiwa Denki Co., Ltd., Nagoya-shi, Aichi (JP)

(72) Inventors: Tadashi Nishida, Nagoya (JP); Masanori Hoshino, Nagoya (JP)

(73) Assignees: SINTOKOGIO, LTD., Nagoya-shi, Aichi (JP); FUJIWA DENKI CO., LTD., Nagoya-shi, Aichi (JP)

( * ) Notice: Subject to any disclaimer, the term of this patent is extended or adjusted under 35 U.S.C. 154(b) by 225 days.

(21) Appl. No.: 15/300,016

(22) PCT Filed: Nov. 28, 2014

(86) PCT No.: PCT/JP2014/081570

§ 371 (c)(1),
(2) Date: Sep. 28, 2016

(87) PCT Pub. No.: WO2015/151333

PCT Pub. Date: Oct. 8, 2015

(65) Prior Publication Data

US 2017/0209921 A1 Jul. 27, 2017

(30) Foreign Application Priority Data

Apr. 1, 2014 (JP) ..... 2014-075647

(51) Int. Cl.
*B61D 15/00* (2006.01)
*B22D 41/12* (2006.01)

(52) U.S. Cl.
CPC ..... *B22D 41/12* (2013.01); *B61D 15/00* (2013.01)

(58) Field of Classification Search
CPC ... B61D 3/00; B61D 3/16; B61D 5/00; B61D 7/00; B61D 7/12; B61D 9/00
See application file for complete search history.

(56) References Cited

FOREIGN PATENT DOCUMENTS

| | | | |
|---|---|---|---|
| CN | 2527378 | | 12/2002 |
| CN | 101244457 | | 8/2008 |
| CN | 86104334 | | 4/2011 |
| CN | 102019418 | | 4/2011 |
| CN | 102271839 | | 12/2011 |
| CN | 103418779 | | 12/2013 |
| DE | 3717220 | A1 | 12/1988 |
| JP | S57-195578 | A | 12/1982 |
| JP | H01-262065 | A | 10/1989 |
| JP | 2009-154192 | A | 7/2009 |

(Continued)

OTHER PUBLICATIONS

International Preliminary Report on Patentability dated Oct. 13, 2016 for PCT/JP2014/081570.

*Primary Examiner* — Robert J McCarry, Jr.
(74) *Attorney, Agent, or Firm* — Drinker Biddle & Reath LLP

(57) ABSTRACT

A ladle transport car includes a car truck body provided with a wheel, a mounting table arranged on the car truck body, a ladle movement mechanism arranged on the mounting table, on which a ladle is mounted and moved in a horizontal direction, and a ladle turning mechanism arranged between the car truck body and the mounting table and turning the ladle by turning the mounting table in a horizontal plane.

20 Claims, 7 Drawing Sheets

(56) References Cited

FOREIGN PATENT DOCUMENTS

| | | | | | |
|---|---|---|---|---|---|
| JP | 2012-166271 | A | | 9/2012 | |
| JP | 2013244504 | | * | 9/2013 | ..... B22D 39/04 |
| JP | 2013-244504 | A | | 12/2013 | |
| WO | WO-2010/122900 | A1 | | 10/2010 | |

* cited by examiner

LADLE TRANSPORT CAR AND MOLTEN METAL TRANSPORT LINE

TECHNICAL FIELD

A variety of aspects of the present invention relate to a ladle transport car for ground transport of a ladle, and a molten metal transport line using the ladle transport car.

BACKGROUND ART

Ground transport means for transporting a ladle filled with molten metal on the ground, such as a car truck, a roller conveyor, and a forklift, have been known (refer to Patent Literatures 1 to 3, for example). This kind of ground transport means has an advantage of having higher safety as compared with aerial transport means, such as a crane, and thus a molten metal transport line, in which some of the ground transport means described above are combined, has also been known.

In many cases, a method as follows has been used: a pouring port is provided in a ladle for transporting molten metal; the ladle is mounted on a pouring apparatus; and the pouring apparatus is driven to directly pour the molten metal into a mold from the pouring port of the ladle. As a pouring apparatus in such a method of pouring molten metal, a forklift (refer to Patent Literature 1) or a pouring car truck (refer to Patent Literatures 2 and 3) is typically used.

In a molten metal transport line using this kind of method of directly pouring molten metal into a mold from a pouring port of a ladle, a direction of the ladle in a transport path of the ladle, or a direction of the pouring port of the ladle in a circumferential direction in a horizontal plane, is important. That is, when the molten metal is poured into the mold from the pouring port of the ladle, the pouring port of the ladle needs to project toward a position at which the mold is arranged. In addition, the molten metal transport line is required to be designed in consideration of achieving a predetermined positional relationship between a position of the pouring port of the ladle and a melting or holding furnace, and a position of each of various treatment apparatuses to prevent the pouring port of the ladle from interfering with the melting or holding furnace, and with the various treatment apparatuses when the ladle receives molten metal from the melting or holding furnace, or when graphite spheroidizing treatment, inoculation treatment, or slag removing treatment is performed in the middle of the transport path.

Conventional molten metal transport lines each use a method of adjusting a direction of a ladle as follows. That is, Patent Literature 1 uses a method of tilting a ladle with a pouring port attached to a forklift that can freely travel in a plant by using power of the forklift to pour molten metal. The forklift can freely travel in the plant in this method, and thus, for example, the ladle can be transported while the pouring port of the ladle is placed toward a position at which a mold is arranged. In Patent Literature 2, a ladle monorail for distributing molten metal, a platform, and a roller conveyor, are arranged at intermediate positions between a melting furnace and a pouring car truck, and a ladle is transported to the pouring car truck while a direction of a ladle is set to a predetermined direction.

Unfortunately, there is the following problem in a molten metal transport line that adjusts a direction of a ladle by using a conventional method. That is, while a forklift needs no rail to enable transport in a free path, a driver needs to be secured. Thus, the forklift is unsuitable for automatization and labor savings, and there is also a problem from a viewpoint of safety because the driver works near the ladle filled with molten metal. In addition, a molten metal transport line, in which a ladle monorail for distributing molten metal, a roller conveyor, and the like, are arranged in a transport path to adjust a direction of a ladle, has the following problems: a large space is required for the monorail and the roller conveyor; and transport of the ladle by using the monorail is unsuitable for automatization, labor savings and space-saving.

CITATION LIST

Patent Literature

Patent Literature 1: Japanese Unexamined Patent Publication No. S57-195578 (refer to the right section in page 1)

Patent Literature 2: Japanese Unexamined Patent Publication No. H1-262065 (refer to FIG. 1)

Patent Literature 3: DE3717220 (refer to FIG. III)

SUMMARY OF INVENTION

Technical Problem

Unfortunately, there is the following problem in a molten metal transport line that adjusts a direction of a ladle by using a conventional method. That is, while a forklift needs no rail to enable transport in a free path, a driver needs to be secured. Thus, the forklift is unsuitable for automatization and labor savings, and there is also a problem from a viewpoint of safety because the driver works near the ladle filled with molten metal. In addition, a molten metal transport line, in which a ladle monorail for distributing molten metal, a roller conveyor, and the like, are arranged in a transport path to adjust a direction of a ladle, has the following problems: a large space is required for the monorail and the roller conveyor; and transport of the ladle by using the monorail is unsuitable for automatization, labor savings and space-saving.

A variety of aspects of the present invention are made to provide a ladle transport car and a molten metal transport line using the ladle transport car. The ladle transport car is capable of freely adjusting a direction of a ladle or a direction of a pouring port of the ladle in a circumferential direction in a horizontal plane in a path transporting the ladle filled with molten metal to increase a degree of freedom of a layout of a molten metal transport line, thereby enabling automatization, labor savings, or space-saving, of the molten metal transport line to reduce costs of the molten metal transport line.

Solution to Problem

To solve the problems described above, in one aspect of the present invention, a ladle transport car moving on a rail is configured as follows. That is, the ladle transport car includes a car truck body provided with a wheel, a mounting table arranged on the car truck body, a ladle movement mechanism arranged on the mounting table, on which a ladle is mounted and moved in a horizontal direction, and a ladle turning mechanism arranged between the car truck body and the mounting table, and turning the ladle by turning the mounting table in a horizontal plane.

In one embodiment, the ladle transport car may further include a lid opening/closing mechanism for opening and closing a lid arranged on the ladle.

In another embodiment, the ladle turning mechanism in the ladle transport car may include a bearing arranged in a coupling section between the car truck body and the mounting table, and rotatably coupling the mounting table to the car truck body, a driven-side fixed chain arranged in an outer peripheral portion of the mounting table, a drive-side sprocket fixed to the car truck body and engaged with the driven-side fixed chain, and a drive motor coupled to the drive-side sprocket and rotationally driving the drive-side sprocket.

In still another embodiment, the ladle transport car may further include a positioning device. The positioning device may include a first positioning mechanism arranged in the car truck body and a second positioning mechanism arranged in the mounting table, and position and fix the mounting table at a predetermined position in a circumferential direction with respect to the car truck body by allowing the first positioning mechanism and the second positioning mechanism to engage with each other.

In still another embodiment, the first positioning mechanism comprises one or more first positioning mechanisms, and the second positioning mechanism comprises one or more second positioning mechanisms. Any one of the first positioning mechanisms and any one of the second positioning mechanisms may engage with each other to position and fix the mounting table at one or more predetermined positions in the circumferential direction with respect to the car truck body.

In still another embodiment, the ladle transport car may further include cable protection means arranged between the car truck body and the mounting table for protecting electric wiring and/or fluid piping.

A molten metal transport line in accordance with another aspect of the present invention is a molten metal transport line for manufacturing cast iron. The molten metal transport line includes the ladle transport car described above, at least one ladle to be filled with molten metal, a rail on which the ladle transport car travels, at least one melting furnace or furnace arranged along the rail, and at least one pouring apparatus arranged along the rail. Molten metal is transported from the at least one melting or holding furnace to the at least one pouring apparatus by using the ladle and the ladle transport car.

In one embodiment, the molten metal transport line may further include a second ladle transport car. The second ladle transport car is the ladle transport car in accordance with the one aspect or the one embodiment of the present invention. Molten metal may be transported from the at least one melting or holding furnace to the at least one pouring apparatus by using the ladle, the ladle transport car, and the second ladle transport car.

Alternatively, in another embodiment, the molten metal transport line may further include a second ladle transport car that moves on a rail. The second ladle transport car includes a car truck body provided with a wheel, a mounting table arranged on the car truck body, and a ladle movement mechanism arranged on the mounting table, on which a ladle is mounted and moved in the horizontal direction. Molten metal may be transported from the at least one melting or holding furnace to the at least one pouring apparatus by using the ladle, the ladle transport car, and the second ladle transport car.

A molten metal transport line in accordance with still another aspect of the present invention is a molten metal transport line for manufacturing cast iron. The molten metal transport line includes at least one ladle to be filled with molten metal, a first rail, a second rail arranged orthogonal and adjacent to the first rail, a first ladle transport car that moves on the first rail, a second ladle transport car that moves on the second rail, at least one melting or holding furnace arranged along the first rail, and at least one pouring apparatus arranged along the second rail. Any of the first ladle transport car and the second ladle transport car is the ladle transport car in accordance with the one aspect or the one embodiment of the present invention described above. Molten metal is transported from the at least one melting or holding furnace to the at least one pouring apparatus by using the ladle, the first ladle transport car, and the second ladle transport car.

A molten metal transport line in accordance with still another aspect of the present invention is a molten metal transport line for manufacturing cast iron. The molten metal transport line includes at least one ladle to be filled with molten metal, a first rail, a second rail arranged orthogonal and adjacent to the first rail, a first ladle transport car that moves on the first rail, a second ladle transport car that moves on the second rail, at least one melting or holding furnace arranged along the first rail, and at least one pouring apparatus arranged along the second rail. Any one of the first ladle transport car and the second ladle transport car is the ladle transport car in accordance with the one aspect or the one embodiment of the present invention described above, and the other ladle transport car includes a car truck body provided with a wheel, a mounting table arranged on the car truck body, and a ladle movement mechanism arranged on the mounting table, on which a ladle is mounted and moved in the horizontal direction. Molten metal is transported from the at least one melting or holding furnace to the at least one pouring apparatus by using the ladle, the first ladle transport car, and the second ladle transport car.

In still another embodiment, the molten metal transport line may further include a ladle storage apparatus arranged along the rail and allowing a ladle that is empty until subsequent transport of molten metal to wait in the ladle storage apparatus.

Advantageous Effects of Invention

According to the ladle transport cars in accordance with a variety of aspects and respective embodiments of the present invention, a direction of the ladle, or a direction of the pouring port of the ladle in a circumferential direction in the horizontal plane, can be freely adjusted in a path for transporting the ladle filled with molten metal. Using this kind of ladle transport car in a molten metal transport line enables increasing a degree of freedom of a layout of the molten metal transport line, thereby enabling automatization, labor savings, or space-saving of the molten metal transport line to reduce costs of the molten metal transport line.

DESCRIPTION OF EMBODIMENTS

Figure 1:
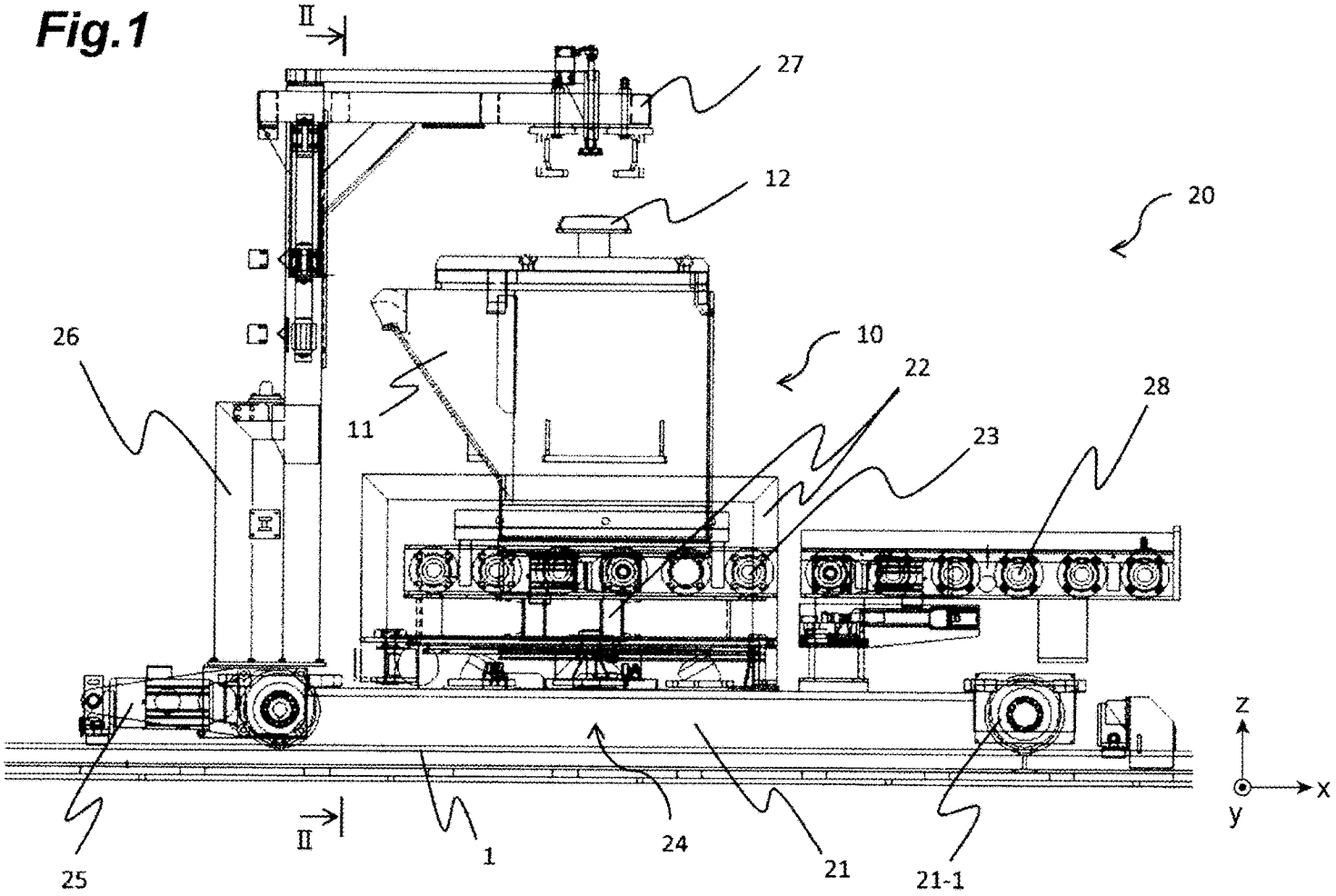
FIG. 1 is a front view of a ladle transport car (in a state where a ladle is mounted) in accordance with an embodiment.
Figure 2:
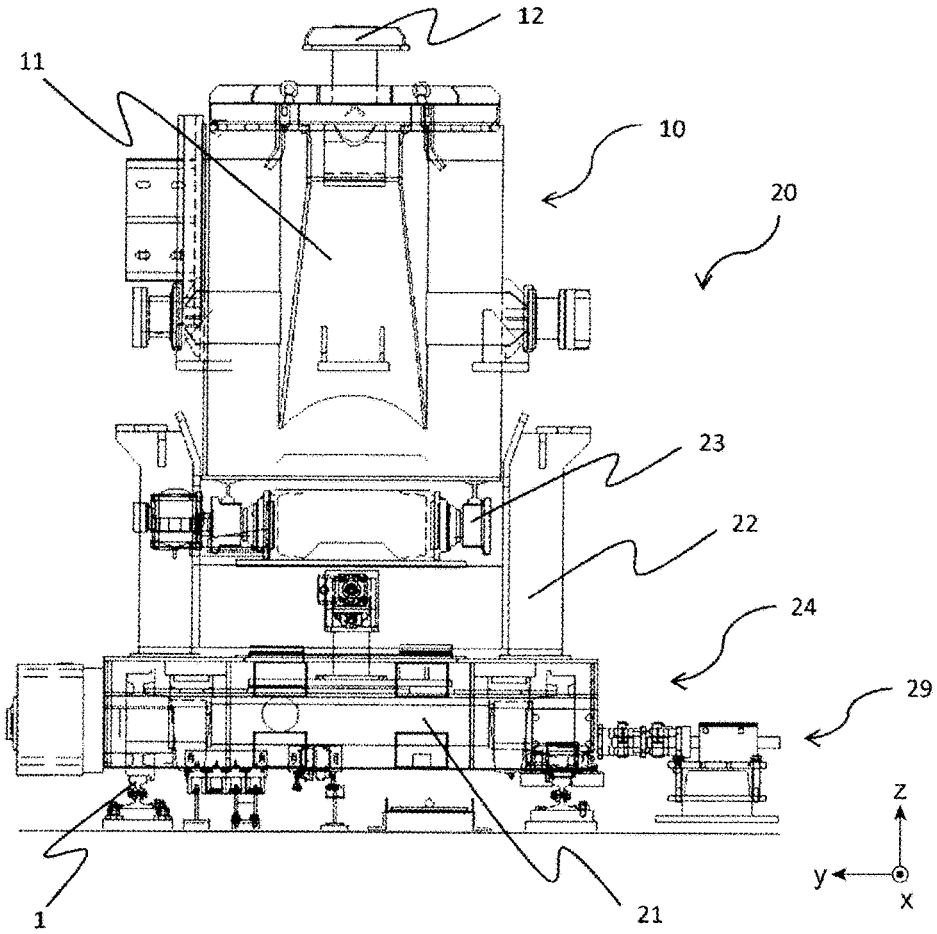
FIG. 2 is a side view of a main section of the ladle transport car (in a state where the ladle is mounted) as viewed from a section shown in FIG. 1.
Figure 3:
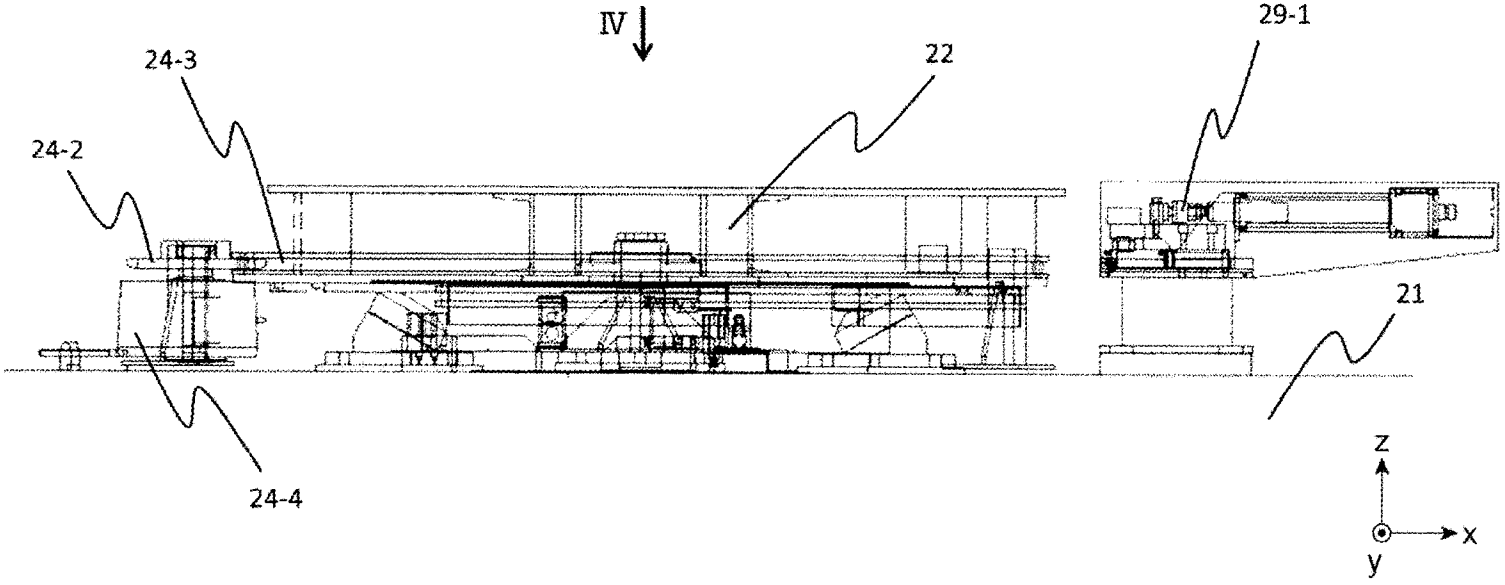
FIG. 3 is a front view of the vicinity of a ladle turning mechanism of the ladle transport car shown in FIG. 1.
Figure 4:
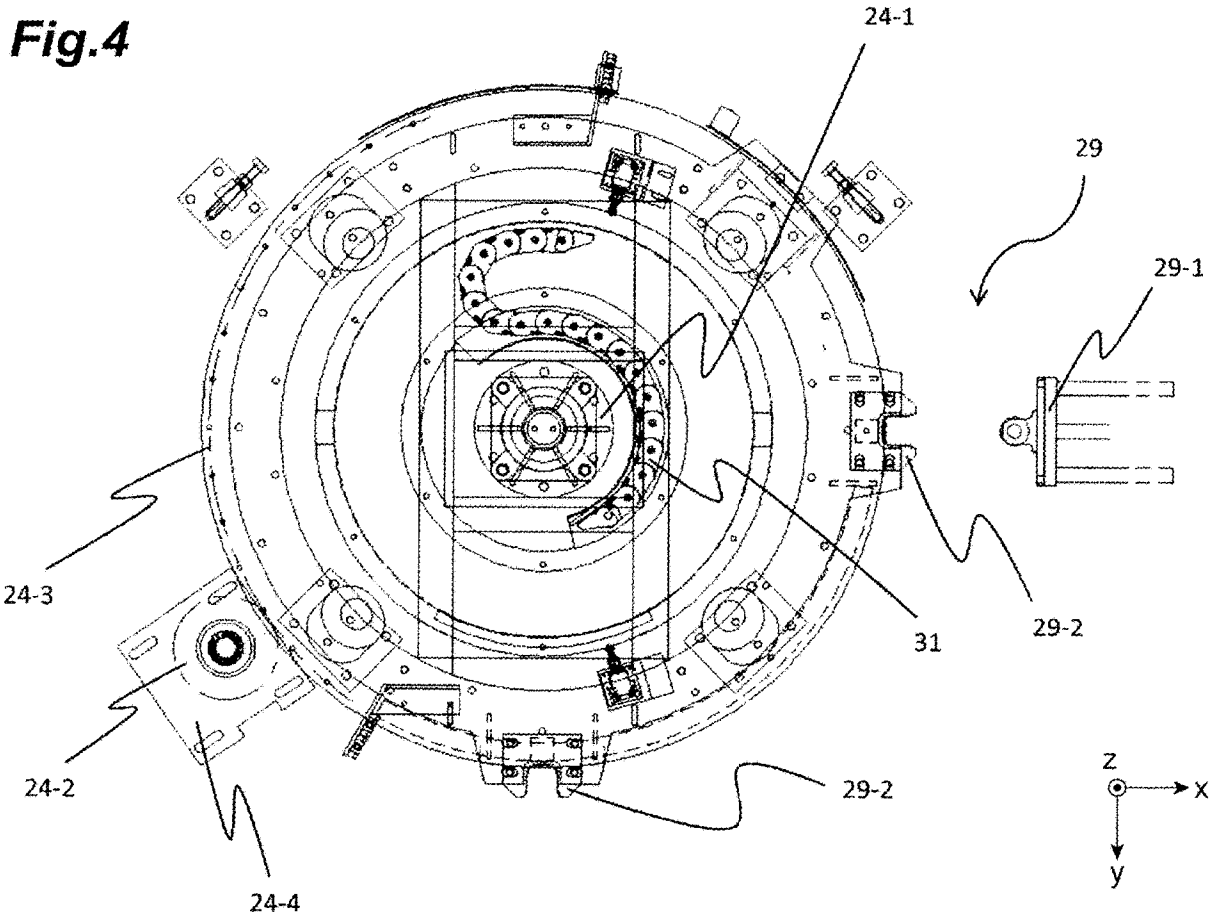
FIG. 4 is a plan view of the vicinity of the ladle turning mechanism of the ladle transport car as viewed from the direction of the arrow IV shown in FIG. 3.

With reference to FIGS. 1 to 4, a ladle transport car in accordance with an embodiment will be described. A ladle transport car 20 in accordance with the embodiment includes a car truck body 21, a mounting table 22, a ladle movement mechanism 23, a ladle turning mechanism 24, a traveling drive mechanism 25, and a control board 26.

The car truck body 21 includes wheels 21-1 to travel on two rails 1 extending in the "x" direction in FIGS. 1 to 4. The mounting table 22 is structurally mounted on the car truck body 21 through the ladle turning mechanism 24. The mounting table 22 includes the ladle movement mechanism 23, and a ladle 10 is to be mounted on the ladle movement mechanism 23. The mounting table 22, the ladle movement mechanism 23, and the ladle 10, are to be integrally turned in a horizontal plane (in an "xy" plane) by the ladle turning mechanism 24. A turn means turning around an axis extending in a vertical direction as a center axis. The embodiment describes a case where a center axis of rotation passes through the center of the mounting table 22, but the center axis is not limited to the case.

The ladle turning mechanism 24 includes a bearing 24-1 arranged in a coupling section between the car truck body 21 and the mounting table 22, a driven-side fixed chain 24-3 arranged and fixed in an outer peripheral portion of the mounting table 22, a drive-side sprocket 24-2 fixed to the car truck body 21 to engage with the driven-side fixed chain 24-3, and a drive motor 24-4 coupled to the drive-side sprocket to rotationally drive the drive-side sprocket. The text, "a coupling section between the car truck body 21 and the mounting table 22" is a portion where the car truck body 21 and the mounting table 22 are mechanically coupled to each other. The bearing 24-1 is arranged in a coupling section between the car truck body 21 and the mounting table 22. For example, an inner race of the bearing 24-1 is axially supported in a structure of the car truck body 21, and an outer race of the bearing 24-2 is axially supported in a structure of the mounting table 22. Accordingly the mounting table 22 is supported rotatably in the horizontal plane with respect to the car truck body 21. A text, "the ladle turning mechanism 24 is arranged between the car truck body 21 and the mounting table 22" means that the ladle turning mechanism 24 is arranged in a structural coupling section between the car truck body 21 and the mounting table 22, and thus the ladle turning mechanism 24 is not simply arranged in a spatial area therebetween. That is, at least a part of the ladle turning mechanism 24 may be arranged in the coupling section between the car truck body 21 and the mounting table 22, and thus the entire structure of the ladle turning mechanism 24 does not need to be arranged in a space defined between the car truck body 21 the mounting table 22. For example, a part of the ladle turning mechanism 24 may be arranged in a portion separated from the space defined between the car truck body 21 and the mounting table 22 (such as a portion separated in a horizontal direction).

The driven-side fixed chain 24-3 and the drive-side sprocket 24-2, for example, may be the pin gear drive system sold by Tsubakimoto Chain Co. In this case, the driven-side fixed chain 24-3 is a chain with an attachment that is arranged and fixed all around an outer peripheral portion on a lower end side of the mounting table 22, or over an angle range required to turn the mounting table 22. The angle range required to turn the mounting table 22 may include an error or a margin of a few percent. The chain with an attachment is wound and fixed around an outer peripheral portion of a structure in the shape of a drum or a table to engage with the drive-side sprocket 24-2 (a sprocket for a pin gear described later), thereby serving as a rotationally driving mechanism.

The drive-side sprocket 24-2 can be a sprocket for a pin gear that engages with the chain with an attachment. This sprocket for a pin gear has a tooth form to be fitted to a shape of the chain with an attachment, and is rotatably supported in the car truck body 21. Teeth of the sprocket for a pin gear are arranged so as to mesh with the chain with an attachment. In addition, the drive motor 24-4, such as a motor with a speed reducer, is coupled to one end of a rotation shaft of the sprocket for a pin gear to rotate the sprocket for a pin gear.

Accordingly, when the drive motor 24-4 is rotationally driven, the sprocket for a pin gear (drive-side sprocket 24-2) turns. Then, the chain with an attachment (driven-side fixed chain 24-3), with which the sprocket for a pin gear engages, turns to allow the mounting table 22, the ladle movement mechanism 23, and the ladle 10 to integrally turn in the horizontal plane. A turning angle of the mounting table 22, the ladle movement mechanism 23, and the ladle 10 can be appropriately set. Changing an installation range of the chain wheel 24-3, for example, enables turning over a range of 90 degrees, 180 degrees, 270 degrees, or 360 degrees.

Although an example of using the pin gear drive system is described here as a mechanism of turning the mounting table 22, the ladle movement mechanism 23, and the ladle 10, the mechanism is not limited to this mechanism. Another turn drive mechanism, such as a gear drive mechanism and a roller chain drive mechanism, is available.

The ladle movement mechanism 23 is arranged on the mounting table 22, and the ladle 10 is to be directly mounted on the ladle movement mechanism 23. The ladle movement mechanism 23 moves the ladle 10 mounted in the horizontal direction, and can use a transportation mechanism, such as a roller conveyor. The ladle movement mechanism 23 is to be used when the ladle 10 is delivered in the molten metal transport line 100, and is configured to rotationally drive a roller of a roller conveyor by using a drive motor or the like to move the ladle 10 horizontally.

The traveling drive mechanism 25 is arranged in the car truck body 21. The traveling drive mechanism 25 allows the ladle transport car 20 to travel on a rail 1, and is configured to rotationally drive a wheel 214 by using a drive motor to allow the whole of the ladle transport car 20 to travel.

The control board 26 is also arranged in the car truck body 21. The control board 26 is configured to control movement of the ladle movement mechanism 23, the ladle turning mechanism 24, and the traveling drive mechanism 25, on the basis of the following: detection data acquired by various sensors, such as a limit switch, a proximity switch, and a position detection switch, arranged inside or outside the ladle transport car 20; a preinstalled program; or input of an operator. The control board 26 may further control movement of a lid opening/closing mechanism 27, a second ladle movement mechanism 28, and a positioning device 29, which are to be described later.

The ladle transport car 20 may further include the lid opening/closing mechanism 27. The lid opening/closing mechanism 27 is directly arranged in the car truck body 21. When a lid 12 is provided to the ladle 10, the lid opening/closing mechanism 27 opens and closes the lid 12 of the ladle 10.

The ladle transport car 20 may also include the second ladle movement mechanism 28. The second ladle movement mechanism 28 can be composed of a transportation mechanism, such as a roller conveyor, similar to the ladle movement mechanism 23. The second ladle movement mechanism 28 is directly arranged in the car truck body 21, and thus the second ladle movement mechanism 28 is fixed integrally with the car truck body 21 without turning like the ladle movement mechanism 23. The second ladle movement mechanism 28 relays movement of the ladle 10 between the ladle movement mechanism 23 and another component in the molten metal transport line 100 when the ladle transport car 20 delivers the ladle 10 in the molten metal transport line 100.

The ladle transport car 20 may also include the positioning device 29 to fix a turn position of the mounting table 22. The positioning device 29 includes a first positioning mechanism 29-1 arranged in the car truck body 21, and a second positioning mechanism 29-2 arranged in the mounting table 22, and positions and fixes the mounting table 22 at a predetermined position in a circumferential direction with respect to the car truck body 21 by allowing the first positioning mechanism 29-1 and the second positioning mechanism 29-2 to engage with each other.

For example, the mounting table 22 may be positioned and fixed at a predetermined position in the circumferential direction with respect to the car truck body 21 as follows: a stopper bracket provided at its leading end with a circular protrusion is used as the first positioning mechanism 29-1; a receiving bracket with a recessed shape corresponding to the circular protrusion of the stopper bracket is used as the second positioning mechanism 29-2; and the stopper bracket and/or the receiving bracket are moved forward by an air cylinder or the like to allow the stopper bracket and the receiving bracket to engage with each other.

At this time, the mounting table 22 may be positioned and fixed at one or more predetermined positions in the circumferential direction with respect to the car truck body 21 as follows: one or more first positioning mechanisms 29-1 and one or more second positioning mechanisms 29-2 are provided; and any one of the first positioning mechanisms 29-1 and any one of the second positioning mechanisms 29-2 are configured to engage with each other. That is, at least one pair of the first positioning mechanism 29-1 and the second positioning mechanism 29-2 may be engaged to fix the mounting table 22 at a specific position in the circumferential direction with respect to the car truck body 21.

The ladle transport car 20 may further include the cable protection means 31. The cable protection means 31 includes a cableveyor (registered trademark), for example. One end of the cable protection means 31 (cableveyor) is fixed to the car truck body 21, and the other end thereof is fixed to the mounting table 22. Then, electric wiring and/or flexible fluid piping are inserted into the cable protection means 31 to enable the electric wiring and/or the fluid piping to be protected from turn movement of the mounting table 22 with respect to the car truck body 21.

Figure 5:
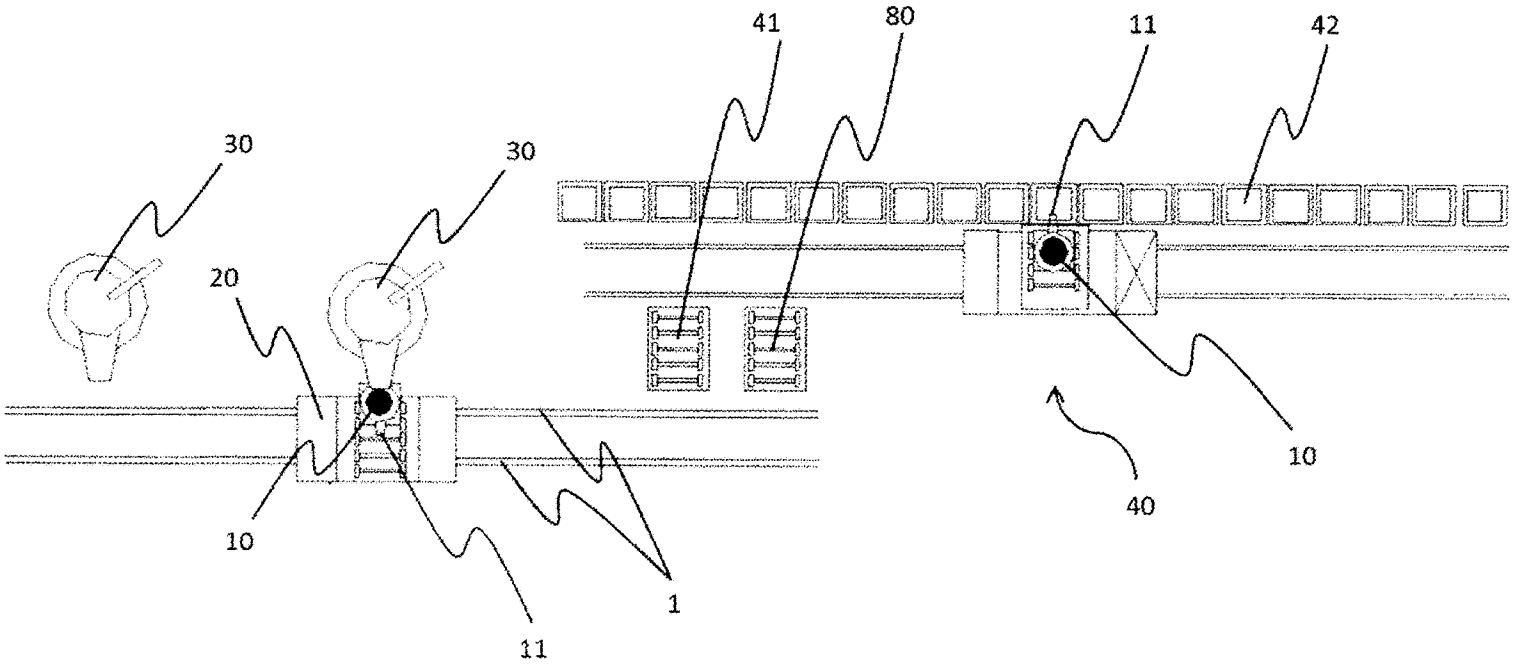
FIG. 5 is a layout chart of a molten metal transport line 100 in accordance with a first embodiment.

Subsequently, the molten metal transport line 100 using the ladle transport car 20 in accordance with an embodiment will be described. FIG. 5 is a layout chart of a molten metal transport line 100 in accordance with a first embodiment. The molten metal transport line 100 in accordance with the first embodiment, for example, is a molten metal transport line for manufacturing cast iron.

The molten metal transport line 100 in accordance with the first embodiment includes the ladle transport car 20 described above, the ladle 10 mounted on the ladle transport car 20 to be transported, the rail 1 on which the ladle transport car 20 travels, one or more melting or holding furnaces 30 arranged along the rail 1, and one or more pouring apparatuses 40 arranged along the rail 1.

The molten metal transport line 100 in accordance with the first embodiment may appropriately include the following and the like at positions along the rail 1: a graphite spheroidizing treatment apparatus 50; an inoculation treatment apparatus 60; a slag removing apparatus 70 (or an apparatus formed by integrating at least two of the graphite spheroidizing treatment apparatus 50, the inoculation treatment apparatus 60, and the slag removing apparatus 70); and/or a ladle storage apparatus 80 that allows the ladle 10 that is empty until subsequent transport of molten metal to wait in the ladle storage apparatus 80. Providing the ladle storage apparatus 80 can appropriately change the ladle 10 to be mounted on the ladle transport car 20. Accordingly, an optimum molten metal transport line 100 can be designed in consideration of the following: capacity of the ladle 10; transportation time of the ladle 10 by using the ladle transport car 20; pouring capability of the pouring apparatus 40; the number of the ladles 10 to be operated; or the like.

In the molten metal transport line 100 configured in this way, the ladle 10 mounted on the ladle transport car 20 receives molten metal from the melting or holding furnace 30 while being on the rail 1 (or on the ladle transport car 20), and then the ladle transport car 20 transports the ladle 10 filled with the molten metal to the pouring apparatus 40. At a position of the pouring apparatus 40, the ladle movement mechanism 23 arranged in the ladle transport car 20 transfers the ladle 10 filled with the molten metal from the ladle transport car 20 to the pouring apparatus 40. In this case, the pouring apparatus 40 may include ladle transport means 41, such as a roller conveyor, to receive the ladle 10 from the ladle movement mechanism 23.

The ladle 10 receives molten metal from the melting or holding furnace 30 while a pouring port 11 of the ladle 10 faces a direction 180 degrees away from a position at which the melting or holding furnace 30 is arranged to prevent a pouring port 11 of the ladle 10 and the melting or holding furnace 30 from interfering with each other.

In the pouring apparatus 40, molten metal is directly poured into a mold from the ladle 10, and thus the pouring port 11 of the ladle 10 needs to face a mold supply line 42. In the first embodiment, the position at which the melting or holding furnace 30 is arranged and a position at which the mold supply line 42 of the pouring apparatus 40 is arranged are on the same side with respect to the rail 1. Thus, the pouring port 11 of the ladle 10 needs to be turned to face a direction 180 degrees apart during transport of the ladle 10 from the melting or holding furnace 30 to the pouring apparatus 40 by using the ladle transport car 20.

In the molten metal transport line 100 in accordance with the first embodiment, the ladle turning mechanism 24 is configured to be started up at a predetermined position (ladle turn position) during transport of the ladle 10 from the melting or holding furnace 30 to the pouring apparatus 40 by using the ladle transport car 20 to integrally turn the mounting table 22, the second ladle movement mechanism 28, and the ladle 10 through 180 degrees. The mounting table 22, the second ladle movement mechanism 28, and the ladle 10 may be integrally turned through 180 degrees not only when the ladle transport car 20 is stopped at the predetermined position (ladle turn position) but also while the ladle transport car 20 moves.

In the molten metal transport line 100 in accordance with the first embodiment, the pouring port 11 of the ladle 10 is configured to face two different turn positions 180 degrees apart, and thus the mounting table 22 may be positioned at this two turn position (two turn positions 180 degrees apart). That is, the positioning device 29 described before may be operated to position and fix the mounting table 22 at two predetermined positions in the circumferential direction with respect to the car truck body 21.

In the molten metal transport line 100 in accordance with the first embodiment, in which the following apparatuses are arranged along the rail 1 in the middle of a transport path of the ladle 10 from the melting or holding furnace 30 to the pouring apparatus 40: the graphite spheroidizing treatment apparatus 50; the inoculation treatment apparatus 60; the slag removing apparatus 70 (or the apparatus formed by integrating at least two of the graphite spheroidizing treatment apparatus 50, the inoculation treatment apparatus 60, and the slag removing apparatus 70); and/or the ladle storage apparatus 80, the ladle 10 may be configured to move between the ladle transport car 20 and each of the apparatuses when molten metal in the ladle 10 is treated, or when an empty ladle 10 is temporarily stored.

In this case, at a position of each of the apparatuses, the ladle movement mechanism 23 arranged in the ladle transport car 20 transfers a ladle 10 filled with molten metal or an empty ladle 10 from the ladle transport car 20 to each of the apparatuses, or from each of the apparatuses to the ladle transport car 20. In this case, the ladle transport means 41, such as a roller conveyor, may be provided in each of the apparatuses to receive the ladle 10 from the ladle movement mechanism 23, or to deliver the ladle 10 to the ladle movement mechanism 23.

When the lid 12 is arranged in the ladle 10, the lid 12 is opened and closed as needed. For example, when the ladle 10 receives molten metal from the melting or holding furnace 30 while being on the ladle transport car 20, the lid opening/closing mechanism 27 arranged in the ladle transport car 20 opens and closes the lid 12 of the ladle 10.

In the case where the second ladle movement mechanism 28 described before is arranged in the ladle transport car 20, when the ladle 10 moves between the ladle transport car 20 and at least one of the following apparatuses described before: the graphite spheroidizing treatment apparatus 50; the inoculation treatment apparatus 60; the slag removing apparatus 70 (or the apparatus formed by integrating at least two of the graphite spheroidizing treatment apparatus 50, the inoculation treatment apparatus 60, and the slag removing apparatus 70); the ladle storage apparatus 80; and the pouring apparatus 40, the second ladle movement mechanism 28 is configured to relay movement of the ladle 10 between the ladle movement mechanism 23 and the apparatuses.

The molten metal transport line 100 in accordance with the first embodiment may further include a second ladle transport car 90 that travels on the rail 1. That is, using the ladle transport car 20 and the second ladle transport car 90 enables not only transport of the ladle 10 between the melting or holding furnace 30 and the pouring apparatus 40, but also transport of the ladle 10 via each of the following apparatuses described before: the graphite spheroidizing treatment apparatus 50; the inoculation treatment apparatus 60; the slag removing apparatus 70 (or the apparatus formed by integrating at least two of the graphite spheroidizing treatment apparatus 50, the inoculation treatment apparatus 60, and the slag removing apparatus 70); and/or the ladle storage apparatus 80.

In this case, the ladle 10 may be directly delivered between the ladle transport car 20 and the second ladle transport car 90 in the middle of a transport path, or may be delivered via each of the following apparatuses: the graphite spheroidizing treatment apparatus 50; the inoculation treatment apparatus 60; the slag removing apparatus 70 (or the apparatus formed by integrating at least two of the graphite spheroidizing treatment apparatus 50, the inoculation treatment apparatus 60, and the slag removing apparatus 70); and/or the ladle storage apparatus 80.

As the second ladle transport car 90, a ladle transport car having the same structure as that of the ladle transport car 20 may be used, or a ladle transport car having a structure formed by removing the ladle turning mechanism 24 from the ladle transport car 20, such as described below, may be used. That is, the second ladle transport car 90 may include the car truck body 21 provided with a wheel, the mounting table 22 arranged on the car truck body 21, and the ladle movement mechanism 23 arranged on the mounting table 22, on which the ladle 10 is mounted and moved in the horizontal direction.

In the description above, a case where the ladle 10 receives molten metal while being on the ladle transport car 20 when receiving the molten metal from the melting or holding furnace 30 has been described, a state of receiving molten metal is not limited to this case. Molten metal also can be received on a ladle transport car that is the second ladle transport car 90 without the ladle turning mechanism 24. Alternatively, the ladle transport means 41, such as a roller conveyor, is provided in the melting or holding furnace 30 to deliver the ladle 10 between the ladle movement mechanism 23 of the ladle transport car 20 and the ladle transport means 41 of the melting or holding furnace 30, and then the ladle 10 may receive molten metal from the melting or holding furnace 30 while being on the ladle transport means 41. For example, as shown in FIG. 5, if the ladle transport means 41 and the ladle storage apparatus 80 are arranged between the pouring apparatus 40 and the rail 1 to transport the ladle 10 filled with molten metal from the ladle transport car 20 to the pouring apparatus 40 by using the ladle transport means 41 and an empty ladle 10 after pouring is finished is placed on the ladle storage apparatus 80 in the pouring apparatus 40, the ladle 10 can be rationally transported. Each of positions of the ladle transport means 41 and the ladle storage apparatus 80 described in FIG. 5 may be reversed.

Figure 6:
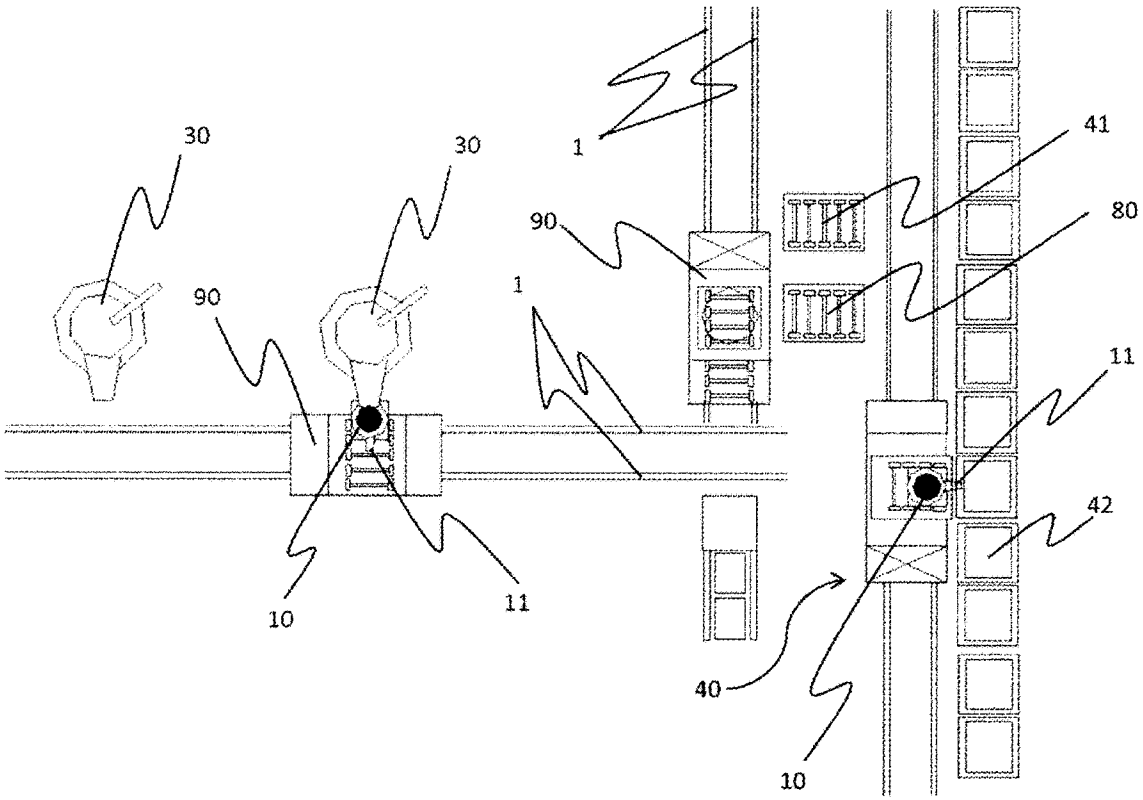
FIG. 6 is a layout chart of a molten metal transport line 100 in accordance with a second embodiment.

Subsequently, a molten metal transport line 100 in accordance with a second embodiment will be described. FIG. 6 is a layout chart of the molten metal transport line 100 in accordance with the second embodiment. In the description below, description of portions common to the molten metal transport line 100 in accordance with the first embodiment and the molten metal transport line 100 in accordance with the second embodiment is omitted. Thus, the molten metal transport line 100 in accordance with the first embodiment and the molten metal transport line 100 in accordance with the second embodiment have the same structure about portions without specific description.

The molten metal transport line 100 in accordance with the second embodiment includes a first rail 1, and a second rail 1 arranged orthogonal and adjacent to the first rail. One or more melting or holding furnaces 30 are arranged along the first rail 1, and one or more pouring apparatuses 40 are arranged along the second rail. At least one first ladle transport car 90 and at least one second ladle transport car 90 are arranged on the first rail 1 and the second rail, respectively. The first ladle transport car 90 and the second ladle transport car 90 each in the present embodiment has the same structure as that of the second ladle transport car 90 in the molten metal transport line 100 in accordance with the first embodiment. That is, the first ladle transport car 90 and the second ladle transport car 90 each indicate a ladle transport car according to a concept including both of a ladle transport car having structure with the ladle turning mechanism 24 and a ladle transport car having structure without the ladle turning mechanism 24. At least one of the first ladle transport car 90 and the second ladle transport car 90 arranged on the first rail 1 and the second rail, respectively, is a ladle transport car having structure with the ladle turning mechanism 24. The first and second ladle transport cars 90 are configured to transport the ladle 10 between the melting or holding furnace 30 and the pouring apparatus 40.

In the present embodiment, when the ladle 10 is transported between the melting or holding furnace 30 and the pouring apparatus 40, the ladle 10 needs to be turned to change a direction of its pouring port 11 by 90 degrees during transport due to a positional relationship among the pouring port 11 of the ladle 10, the melting or holding furnace 30, and the pouring apparatus 40. The ladle 10 is turned by the first or second ladle transport car 90 provided with the ladle turning mechanism 24.

In the molten metal transport line 100 in accordance with the second embodiment, when the ladle 10 is delivered between the first rail and the second rail, the ladle 10 is directly delivered between the first ladle transport car 90 arranged on the first rail and the second ladle transport car 90 arranged on the second rail near a coupling section between the first rail and the second rail.

Figure 7:
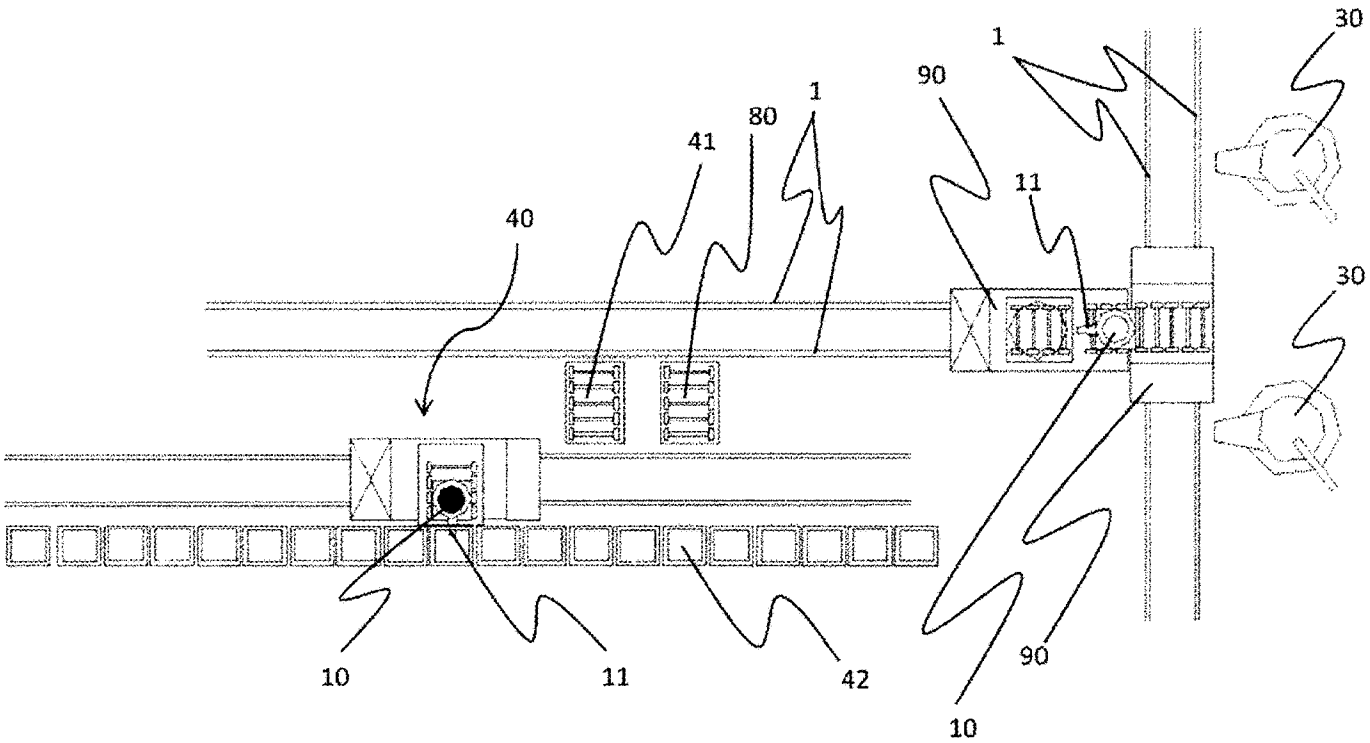
FIG. 7 is a layout chart of a molten metal transport line 100 in accordance with a third embodiment.

Subsequently, a molten metal transport line 100 in accordance with a third embodiment will be described. FIG. 7 is a layout chart of the molten metal transport line 100 in accordance with the third embodiment. In the description below, description of portions common to the molten metal transport lines 100 in accordance with the first and second embodiments, and the molten metal transport line 100 in accordance with the third embodiment, is omitted. Thus, the molten metal transport lines 100 in accordance with the first and second embodiments, and the molten metal transport line 100 in accordance with the third embodiment, have the same structure about portions without specific description.

The molten metal transport line 100 in accordance with the third embodiment is the same as the molten metal transport line 100 in accordance with the second embodiment except a position at which a first rail 1 and a second rail 1 arranged orthogonal and adjacent to the first rail are coupled to each other.

Thus, also in the present embodiment, as with the molten metal transport line 100 in accordance with the second embodiment, when the ladle 10 is transported between the melting or holding furnace 30 and the pouring apparatus 40, the ladle 10 needs to be turned to change a direction of its pouring port 11 by 90 degrees during transport due to a positional relationship among the pouring port 11 of the ladle 10, the melting or holding furnace 30, and the pouring apparatus 40. The ladle 10, as with the molten metal transport line 100 in accordance with the second embodiment, is turned by the first or second ladle transport car 90 provided with the ladle turning mechanism 24.

REFERENCE SIGNS LIST

1 . . . rail, 10 . . . ladle, 11 . . . pouring port, 12 . . . lid, 20 . . . ladle transport car, 21 . . . car truck body, 21-1 . . . wheel, 22 . . . mounting table, 23 . . . ladle movement mechanism, 24 . . . ladle turning mechanism, 24-1 . . . bearing, 24-2 . . . drive-side sprocket, 24-3 . . . driven-side fixed chain, 24-4 . . . drive motor, 25 . . . traveling drive mechanism, 26 . . . control board, 27 . . . lid opening/closing mechanism, 28 . . . second ladle movement mechanism, 29 . . . positioning device, 29-1 . . . first positioning mechanism, 29-2 . . . second positioning mechanism, 30 . . . melting or holding furnace, 31 . . . cable protection means, 40 . . . pouring apparatus, 41 . . . ladle transport means, 42 . . . mold supply line, 50 . . . graphite spheroidizing treatment apparatus (not shown), 60 . . . inoculation treatment apparatus (not shown), 70 . . . slag removing apparatus (not shown), 80 . . . ladle storage apparatus, 90 . . . first and second ladle transport cars, 100 . . . molten metal transport line.

The invention claimed is:

1. A ladle transport car moving on a rail of a molten metal transport line, comprising:

a car truck body provided with a wheel;

a mounting table arranged on the car truck body;

a ladle movement mechanism arranged on the mounting table, on which a ladle is mounted and moved in a horizontal direction and configured to transfer the ladle from the ladle transport car to an apparatus of the molten metal transport line or from the apparatus of the molten metal transport line to the ladle transport car; and a ladle turning mechanism arranged between the car truck body and the mounting table, and turning the ladle by turning the mounting table in a horizontal plane.

2. The ladle transport car according to claim 1, further comprising:

a lid opening/closing mechanism for opening and closing a lid arranged on the ladle.

3. The ladle transport car according to claim 1, wherein the ladle turning mechanism includes a bearing arranged in a coupling section between the car truck body and the mounting table, and rotatably coupling the mounting table to the car truck body, a driven-side fixed chain arranged in an outer peripheral portion of the mounting table, a drive-side sprocket fixed to the car truck body and engaged with the driven-side fixed chain, and a drive motor coupled to the drive-side sprocket and rotationally driving the drive-side sprocket.

4. The ladle transport car according to claim 1, further comprising a positioning device, wherein the positioning device includes a first positioning mechanism arranged in the car truck body and a second positioning mechanism arranged in the mounting table, and positions and fixes the mounting table at a predetermined position in a circumferential direction with respect to the car truck body by allowing the first positioning mechanism and the second positioning mechanism to engage with each other.

5. The ladle transport car according to claim 4, wherein the first positioning mechanism comprises one or more first positioning mechanisms, and the second positioning mechanism comprises one or more second positioning mechanisms, and positions and fixes the mounting table at one or more predetermined positions in the circumferential direction with respect to the car truck body by allowing any one of the first positioning mechanisms and any one of the second positioning mechanisms to engage with each other.

6. The ladle transport car according to claim 1, further comprising cable protection means arranged between the car truck body and the mounting table for protecting electric wiring and/or fluid piping.

7. A molten metal transport line for manufacturing cast iron, the molten metal transport line comprising:
a ladle transport car;
at least one ladle to be filled with molten metal;
a rail on which the ladle transport car travels;
at least one melting or holding furnace arranged along the rail; and
at least one pouring apparatus arranged along the rail, wherein
the ladle transport car includes
a car truck body provided with a wheel;
a mounting table arranged on the car truck body;
a ladle movement mechanism arranged on the mounting table, on which the ladle is mounted and moved in a horizontal direction, and configured to transfer the ladle from the ladle transport car to an apparatus of the molten metal transport line or from the apparatus of the molten metal transport line to the ladle transport car; and
a ladle turning mechanism arranged between the car truck body and the mounting table, and turning the ladle by turning the mounting table in a horizontal plane, and
molten metal is transported from the at least one melting or holding furnace to the at least one pouring apparatus by using the ladle and the ladle transport car.

8. The molten metal transport line according to claim 7, further comprising a second ladle transport car that moves on the rail, wherein
the second ladle transport car includes
a car truck body provided with a wheel;
a mounting table arranged on the car truck body;
a ladle movement mechanism arranged on the mounting table, on which the ladle is mounted and moved in a horizontal direction, and configured to transfer the ladle from the ladle transport car to an apparatus of the molten metal transport line or from the apparatus of the molten metal transport line to the ladle transport car; and
a ladle turning mechanism arranged between the car truck body and the mounting table, and turning the ladle by turning the mounting table in a horizontal plane, and
molten metal is transported from the at least one melting or holding furnace to the at least one pouring apparatus by using the ladle, the ladle transport car, and the second ladle transport car.

9. The molten metal transport line according to claim 7, further comprising a second ladle transport car that moves on the rail, wherein
the second ladle transport car includes
a car truck body provided with a wheel,
a mounting table arranged on the car truck body, and
a ladle movement mechanism arranged on the mounting table, on which a ladle is mounted and moved in the horizontal direction, and configured to transfer the ladle from the ladle trans port car to an apparatus of the molten metal transport line or from the apparatus of the molten metal transport line to the ladle transport car, and
molten metal is transported from the at least one melting or holding furnace to the at least one pouring apparatus by using the ladle, the ladle transport car, and the second ladle transport car.

10. A molten metal transport line for manufacturing cast iron, the molten metal transport line comprising:
at least one ladle to be filled with molten metal;
a first rail;
a second rail arranged orthogonal and adjacent to the first rail;
a first ladle transport car that moves on the first rail;
a second ladle transport car that moves on the second rail;
at least one melting or holding furnace arranged along the first rail; and
at least one pouring apparatus arranged along the second rail, wherein
any of the first ladle transport car and the second ladle transport car is the ladle transport car including
a car truck body provided with a wheel;
a mounting table arranged on the car truck body;
a ladle movement mechanism arranged on the mounting table, on which the ladle is mounted and moved in a horizontal direction, and configured to transfer the ladle from the ladle transport car to an apparatus of the molten metal transport line or from the apparatus of the molten metal transport line to the transport car; and
a ladle turning mechanism arranged between the car truck body and the mounting table, and turning the ladle by turning the mounting table in a horizontal plane, and
molten metal is transported from the at least one melting or holding furnace to the at least one pouring apparatus by using the ladle, the first ladle transport car, and the second ladle transport car.

11. A molten metal transport line for manufacturing cast iron, the molten metal transport line comprising:
at least one ladle to be filled with molten metal;
a first rail;
a second rail arranged orthogonal and adjacent to the first rail;
a first ladle transport car that moves on the first rail;
a second ladle transport car that moves on the second rail;
at least one melting or holding furnace arranged along the first rail; and
at least one pouring apparatus arranged along the second rail, wherein
any one of the first ladle transport car and the second ladle transport car is the ladle transport car including
a car truck body provided with a wheel;
a mounting table arranged on the car truck body;
a ladle movement mechanism arranged on the mounting table, on which the ladle is mounted and moved in a horizontal direction, and configured to transfer the ladle from the ladle transport car to an apparatus of the molten metal transport line or from the apparatus of the molten metal transport line to the ladle transport car; and
a ladle turning mechanism arranged between the car truck body and the mounting table, and turning the ladle by turning the mounting table in a horizontal plane, and
the other ladle transport car includes
a car truck body provided with a wheel,
a mounting table arranged on the car truck body, and
a ladle movement mechanism arranged on the mounting table, on which a ladle is mounted and moved in the horizontal direction, and
molten metal is transported from the at least one melting or holding furnace to the at least one pouring apparatus by using the ladle, the first ladle transport car, and the second ladle transport car.

12. The molten metal transport line according to claim 7, further comprising a ladle storage apparatus arranged along the rail and allowing a ladle that is empty until subsequent transport of molten metal to wait in the ladle storage apparatus.

13. The molten metal transport line according to claim 10, further comprising a ladle storage apparatus arranged along the rail and allowing a ladle that is empty until subsequent transport of molten metal to wait in the ladle storage apparatus.

14. The molten metal transport line according to claim 11, further comprising a ladle storage apparatus arranged along the rail and allowing a ladle that is empty until subsequent transport of molten metal to wait in the ladle storage apparatus.

15. The ladle transport car according to claim 2, wherein the ladle turning mechanism includes a bearing arranged in a coupling section between the car truck body and the mounting table, and rotatably coupling the mounting table to the car truck body, a driven-side fixed chain arranged in an outer peripheral portion of the mounting table, a drive-side sprocket fixed to the car truck body and engaged with the driven-side fixed chain, and a drive motor coupled to the drive-side sprocket and rotationally driving the drive-side sprocket.

16. The ladle transport car according to claim 2, further comprising a positioning device, wherein the positioning device includes a first positioning mechanism arranged in the car truck body and a second positioning mechanism arranged in the mounting table, and positions and fixes the mounting table at a predetermined position in a circumferential direction with respect to the car truck body by allowing the first positioning mechanism and the second positioning mechanism to engage with each other.

17. The ladle transport car according to claim 3, further comprising a positioning device, wherein the positioning device includes a first positioning mechanism arranged in the car truck body and a second positioning mechanism arranged in the mounting table, and positions and fixes the mounting table at a predetermined position in a circumferential direction with respect to the car truck body by allowing the first positioning mechanism and the second positioning mechanism to engage with each other.

18. The ladle transport car according to claim 15, further comprising a positioning device, wherein the positioning device includes a first positioning mechanism arranged in the car truck body and a second positioning mechanism arranged in the mounting table, and positions and fixes the mounting table at a predetermined position in a circumferential direction with respect to the car truck body by allowing the first positioning mechanism and the second positioning mechanism to engage with each other.

19. The ladle transport car according to claim 16, wherein the first positioning mechanism comprises one or more first positioning mechanisms, and the second positioning mechanism comprises one or more second positioning mechanisms, and positions and fixes the mounting table at one or more predetermined positions in the circumferential direction with respect to the car truck body by allowing any one of the first positioning mechanisms and any one of the second positioning mechanisms to engage with each other.

20. The ladle transport car according to claim 17, wherein the first positioning mechanism comprises one or more first positioning mechanisms, and the second positioning mechanism comprises one or more second positioning mechanisms, and positions and fixes the mounting table at one or more predetermined positions in the circumferential direction with respect to the car truck body by allowing any one of the first positioning mechanisms and any one of the second positioning mechanisms to engage with each other.

* * * * *